US006182539B1

(12) United States Patent
Webster

(10) Patent No.: US 6,182,539 B1
(45) Date of Patent: Feb. 6, 2001

(54) TELESCOPING HANDLE ASSEMBLY

(76) Inventor: Beverly Eugene Webster, 8540 Pinehurst Cir., Roanoke, VA (US) 24019

( * ) Notice: Under 35 U.S.C. 154(b), the term of this patent shall be extended for 0 days.

(21) Appl. No.: 09/382,038

(22) Filed: Aug. 24, 1999

(51) Int. Cl.[7] ..... B25B 23/16
(52) U.S. Cl. ..... 81/177.2; 81/489
(58) Field of Search ..... 81/177.2, 488, 81/489; 403/109.1, 109.2, 109.3, 109.4, 109.5, 377

(56) References Cited

U.S. PATENT DOCUMENTS

| | | | | |
|---|---|---|---|---|
| 3,072,425 | | 1/1963 | Nicholls . | |
| 4,182,364 | * | 1/1980 | Gilbert et al. | 137/426 |
| 4,596,405 | * | 6/1986 | Jones | 280/823 |
| 5,433,551 | | 7/1995 | Gordon . | |
| 5,481,950 | | 1/1996 | Browning . | |
| 5,492,430 | | 2/1996 | Jones . | |
| 5,593,239 | * | 1/1997 | Sallee | 403/109 |
| 5,649,780 | | 7/1997 | Schall . | |
| 5,823,699 | * | 10/1998 | Austin, Jr. et al. | 403/109 |

* cited by examiner

*Primary Examiner*—Timothy V. Eley
*Assistant Examiner*—Dung Van Nguyen
(74) *Attorney, Agent, or Firm*—Tarolli, Sundheim, Covell, Tummino & Szabo L.L.P.

(57) ABSTRACT

A telescoping handle assembly includes inner and outer telescoping handle sections. The inner section has an outer surface and a series of grooves at predetermined locations spaced along the length of the inner section. The outer section includes locking teeth that are fixed axially in position along the length of the outer section and that are resiliently movable between a locked condition disposed in one of the grooves on the inner section and an unlocked condition. The handle assembly includes a locking sleeve movable in a first direction to apply radially inwardly directed force to the locking teeth to maintain the locking teeth in the locked condition and thereby to block telescopic movement of the inner section relative to the outer section. The locking sleeve is movable in a second direction opposite the first direction to enable movement of the locking teeth out of the locking condition thereby to enable telescopic movement of the inner section relative to the outer section.

11 Claims, 3 Drawing Sheets

TELESCOPING HANDLE ASSEMBLY

BACKGROUND OF THE INVENTION

1. Technical Field

The present invention relates to a telescoping handle assembly and, in particular, to a locking mechanism for a telescoping handle assembly for a tool for use with a railroad car.

2. Description of the Prior Art

U.S. Pat. No. 5,481,950 describes a multipurpose tool for use with a railroad car. The tool is used to turn a brake wheel to set and release the brake of the railroad car. The tool includes a telescoping handle and is used by pulling on the tool to turn the brake wheel. The tool is also usable, by pushing, to adjust a retainer valve. The locking mechanism of the telescoping handle is not described. One tool manufactured in accordance with U.S. Pat. No. 5,481,950 has a locking mechanism that includes cams engageable with the inner surface of a cylindrical tube. The tool is lockable at any position within its overall range, by a friction locking by the cams.

U.S. Pat. No. 5,649,780 describes a collet for a telescoping assembly including a plurality of flexible fingers that are cammed radially to hold two tube sections together against relative axial movement.

SUMMARY OF THE INVENTION

The present invention is a telescoping handle assembly comprising interfitting first and second telescoping handle sections. The first handle section has an outer surface and a series of grooves extending inward from the outer surface at predetermined locations spaced along the length of the first handle section, the grooves defining predetermined locking positions of the first handle section relative to the second handle section. The second handle section includes locking teeth that are fixed axially in position along the length of the second handle section and that are movable between a locked condition disposed in one of the grooves on the first handle section and an unlocked condition. The handle assembly comprises a locking sleeve movable in a first direction to apply radially inwardly directed force to the locking teeth to maintain the locking teeth in the locked condition and thereby to block telescopic movement of the first handle section relative to the second handle section. The locking sleeve is movable in a second direction opposite the first direction to enable movement of the locking teeth out of the locking condition thereby to enable telescopic movement of the first handle section relative to the second handle section.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
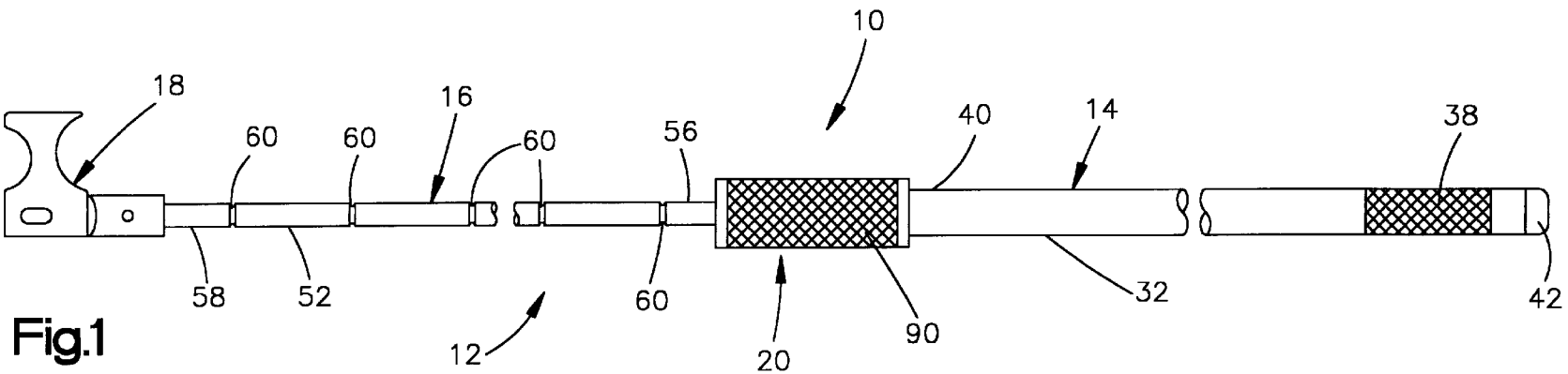
FIG. 1 is an elevational view of a handle assembly in accordance with the present invention.

The present invention relates to a telescoping handle assembly and, in particular, to a locking mechanism for a telescoping handle assembly. As representative of the present invention, FIG. 1 illustrates a telescoping handle assembly 10 that is part of a tool 12 for use with a railroad car.

The tool 12 includes an outer handle section or outer tube 14, an inner handle section or inner tube 16 telescopically received within the outer tube, a hook or head 18 mounted on the end of the inner tube, and a locking mechanism 20 for locking the inner tube in position relative to the outer tube.

The outer tube 14 is made from metal, preferably stainless steel or aluminum. The outer tube 14 has a cylindrical configuration including parallel, cylindrical inner and outer side surfaces 30 and 32 centered on a longitudinal central axis 34 of the handle assembly 10. The inner surface 30 of the outer tube 14 defines a cylindrical central opening 36 within the outer tube 14.

The outer tube 14 has a first or lower (when the tool 12 is held upright) end portion 38 and an opposite second or upper end portion 40. The lower end portion 38 of the outer tube 14 is internally threaded and receives an end cap 42. The end cap 42 closes the central opening 36 in the outer tube 14. An elastomeric bumper 44 is bolted to the end cap 42 by a bolt 45. The upper end portion 40 of the outer tube 14 is externally threaded.

The inner tube 16 is made from metal, preferably the same material as the outer tube. The inner tube 16 has a cylindrical configuration including parallel, cylindrical inner and outer side surfaces 50 and 52 centered on the axis 34. (The inner tube 16 may, alternatively, be a solid rod rather than a tube.) The inner surface 50 defines a cylindrical central opening 54 within the inner tube 16. The inner tube 16 has a first or lower end portion 56 and an opposite second or upper end portion 58.

A guide bolt 59 is screwed into the lower end portion 56 of the inner tube 16. The guide bolt guides sliding movement of the inner tube 16 within the outer tube 14. The guide bolt 59 also engages the bumper 44 upon full closure of the handle assembly 10. The guide bolt 59 also acts as a safety catch to prevent separation of the inner tube 16 and the outer tube 14 upon full extension.

The outer diameter of the inner tube 16 is slightly less than the inner diameter of the outer tube 14. The inner tube 16 is telescopically received within, and is slidable within, the outer tube 14.

A series of locking grooves 60 are formed on the outer periphery of the inner tube 16. The grooves 60 are spaced apart at predetermined locations along the length of the inner tube 16. Each one of the grooves 60 has a trapezoidal cross-sectional configuration. Each groove 60 has a lower end surface 60*a* disposed closer to the lower end portion 56 of the inner tube 16. Each groove also has an upper end surface 60*b* disposed closer to the upper end portion 58 of the inner tube 16. Each groove also has a bottom surface 60*c* that extends parallel to the axis 34 and joins the associated upper and lower end surfaces 60*a* and 60*b*.

The head 18 of the tool 12 is attached to the upper end portion 58 of the inner tube 16. The head 18 is adapted to turn a brake wheel to set and release the brake of a railroad car. The head 18 is also adapted to adjust a retainer valve mechanism of a railroad car. The head 18 is preferably of the configuration described in the aforementioned U.S. Pat. No.

5,481,950, the entire disclosure of which is hereby incorporated by reference.

The locking mechanism 20 of the telescoping handle assembly 10 includes a latch body 70. The latch body 70 has a main body portion 72 that is internally threaded. The main body portion 72 of the latch body 70 is screwed onto the externally threaded upper end portion 40 of the outer tube 14. The latch body 70 is thus fixed to the outer tube 14 and projects axially from the upper end portion 40 of the outer tube.

The latch body 70 has a tubular, cylindrical finger portion 74 that extends axially from the main body portion 72. The inside diameter of the finger portion 74 is slightly larger than the outside diameter of the inner tube.

A series of axially extending slots 76 are formed in the finger portion 74 of the latch body 70. The slots 76 divide the finger portion 74 of the latch body 70 into a plurality of locking fingers 80. In the illustrated embodiment, the latch body 70 includes six locking fingers 80. The locking fingers 80 are resiliently movable relative to the main body portion 72 of the latch body 70.

Each locking finger 80 has a distal end portion 82 on which is formed an internal locking tooth 84. The teeth 84 extend radially inward from the locking fingers 82. Each tooth 84 has a generally trapezoidal cross-sectional configuration, complementary to the configuration of the grooves 60 on the inner tube 16. Thus, each tooth 84 has a lower end surface 84*a* disposed relatively near to the main body portion 72 of the latch body 70. Each tooth also has an upper end surface 84*b* disposed relatively far from the main body portion 72 of the latch body 70. Each tooth also has a bottom surface 84*c* that extends parallel to the axis 34 and joins the associated lower and upper end surfaces 84*a* and 84*b*. The lower end surfaces 84*a* and the upper end surfaces 84*b* all extend transverse to the axis 34.

The distal end portion 82 of each locking finger 80 also includes an outer wedge surface 86 that tapers radially outward in a direction toward the main body portion 72 of the latch body 70.

The locking mechanism includes a locking sleeve 90. The locking sleeve 90 is a tubular, cylindrical member having an internal thread 92. The locking sleeve 90 is screwed on the latch body 70 and is rotatable relative to the latch body. As a result, the locking sleeve 90 moves axially relative to the latch body 70 when the locking sleeve is rotated on the latch body.

An annular, radially extending lip 94 is formed at the lower end portion of the locking sleeve 90. A snap ring groove 96 is formed in the internal threads of the locking sleeve 90. A snap ring 98 is disposed in the snap ring groove 96.

A wedge 100 is secured within the locking sleeve 90. The wedge 100 is screwed into the internal thread 92 of the locking sleeve 90 and bottoms out against the snap ring 98. The wedge 100 is thus fixed for movement with the locking sleeve 90, both rotationally about the axis 34, and axially in a direction along the axis.

The wedge 100 has a central opening 102 defined by a series of internal surfaces of the wedge. The series of internal surfaces includes a frustoconical surface 104 that extends radially outward and axially in a direction toward the snap ring 98. The length of the locking sleeve 90, and the position of the wedge 100 in the locking sleeve, are selected so that the frustoconical surface 104 on the wedge is disposed radially outward of the distal end portions 82 of the locking fingers 80.

It should be understood that the wedge 100 could be formed as one piece with the locking sleeve 90. Thus, the locking sleeve 90 could have portions formed as wedge surfaces to function as the wedge 100.

Figure 2:
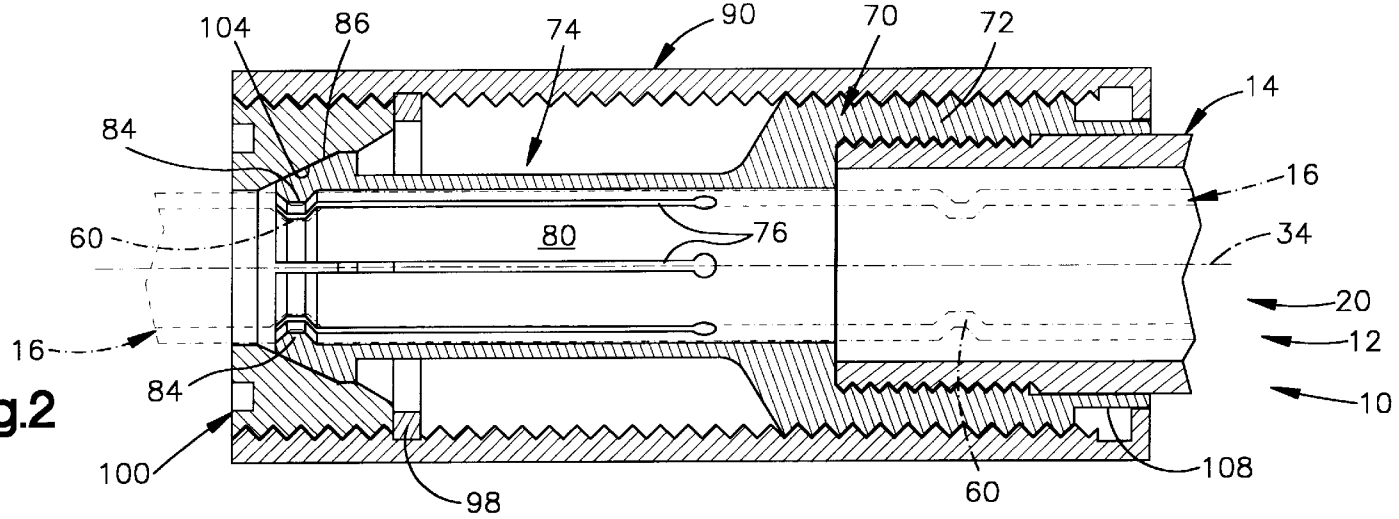
FIG. 2 is an enlarged sectional view of a locking mechanism that forms a part of the handle assembly of FIG. 1, with the parts of the locking mechanism shown in a locked condition.
Figure 3:
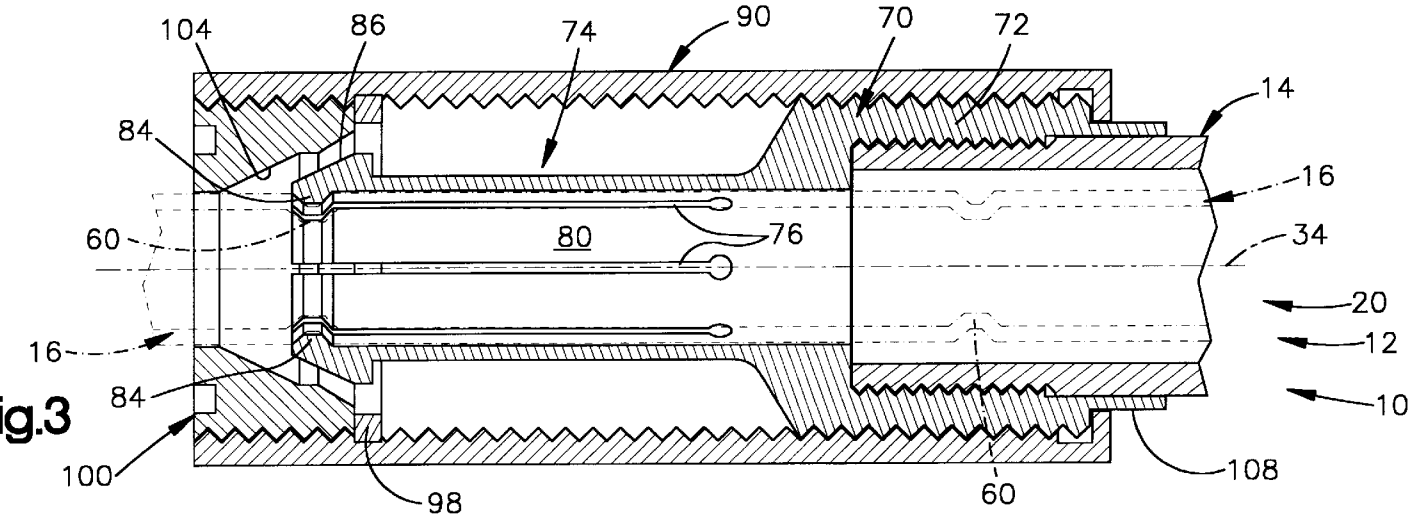
FIG. 3 is a view similar to FIG. 2 with the parts of the locking mechanism shown in an unlocked condition.
Figure 4:
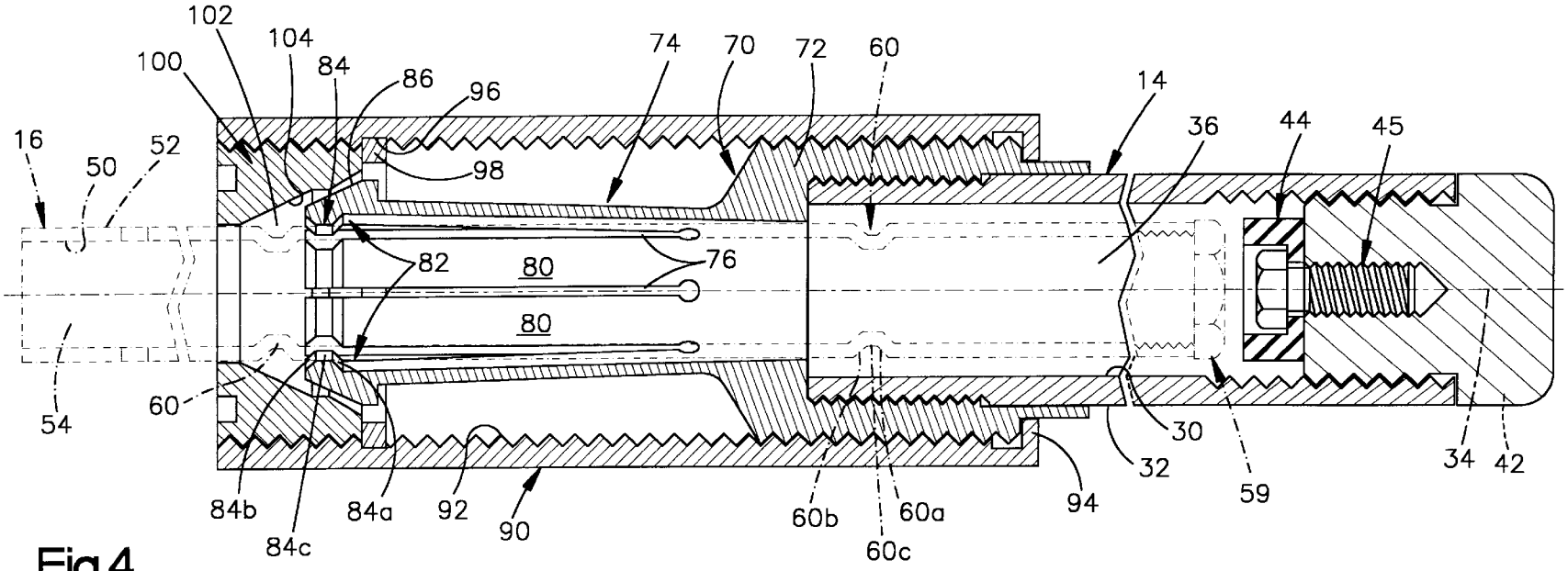
FIG. 4 is a view similar to FIG. 2 with the parts of the locking mechanism shown in a free condition.

When the handle assembly 10 is assembled as shown in the drawings, the inner tube 16 extends within the latch body 70, the wedge 100, and the locking sleeve 90. The parts of the handle assembly 10 are movable between a locked condition as shown in FIG. 2 and an unlocked condition as shown in FIGS. 3 and 4. The parts assume these conditions by movement of the inner tube 16, the locking sleeve 90 and the wedge 100 relative to the outer tube 14.

FIG. 2 illustrates the parts of the handle assembly 10 in the locked condition. The inner tube 16 is positioned relative to the outer tube 14 so that one of the grooves 60 in the inner tube is disposed radially inward of the distal end portions 82 of the locking fingers 80. The teeth 84 on the locking fingers 80 are disposed in the groove 60 in the inner tube 16.

In this condition, the lower end surface 84*a* of each tooth 84 is in abutting engagement with the lower end surface 60*a* of the groove 60. The upper end surface 84*b* of each tooth 84 is in abutting engagement with the upper end surface 60*b* of the groove 60. The bottom surface 84*c* of each tooth 84 is spaced radially outward from the bottom surface 60*c* of the groove 60.

The wedge 100 is in abutting engagement with the locking fingers 80. The frustoconical surface 104 on the wedge 100 is in abutting engagement with the wedge surfaces 86 on the locking fingers 80. This engagement of the wedge 100 with the locking fingers 80 applies a radially inwardly directed force to the locking fingers and holds the locking teeth 84 securely in the groove 60.

The engagement of the locking teeth 84 on the latch body 70 with the groove 60 on the inner tube 16 blocks axial movement of the inner tube 16 relative to the latch body. Because the latch body 70 is fixed in position on the outer tube 14, the inner tube 16 is thus positively blocked from axial movement relative to the outer tube 14. This blocking does not merely result from a radially inwardly directed clamping force, but rather from the inability of the groove 60 on the inner tube 16 to move axially past the locking teeth 84 of the latch body 70. A handle assembly 10 constructed in accordance with the present invention has been tested to withstand 7,000 pounds of tensile force when in the locked condition.

The handle assembly 10 is movable out of the locked condition by rotating the locking sleeve 90 about the axis 34. As the locking sleeve 90 rotates, it moves axially along the latch body 70, in a direction to the left as viewed in FIGS. 2 and 3. The movement of the locking sleeve 90 causes the wedge 100, which is fixed in the locking sleeve, to move axially and rotationally with the locking sleeve.

The frustoconical surface 104 on the wedge 100 moves off the wedge surfaces 86 on the locking fingers 80. The locking fingers 80 are free to move radially outward, out of the groove 60 in the inner tube 16. The handle assembly 10 is then in a partially unlocked condition as shown in FIG. 3. At least two full turns of the locking sleeve 90 are needed to move the handle assembly 10 from the locked condition to the partially unlocked condition. This minimizes the possibility of accidentally unlocking the handle assembly 10.

When the handle assembly 10 is in the partially unlocked condition, a shoulder 108 on the latch body 70 is exposed (FIG. 3) to indicate the partially unlocked condition. The shoulder 108 is covered when the handle assembly is in the locked condition (FIG. 2).

When the handle assembly 10 is in the partially unlocked condition, the inner tube 16 can be moved axially relative to the outer tube 14. A relatively small amount of axially directed force on the inner tube 16, for example to the left as viewed in FIGS. 2 and 3, causes the lower end surface 60*a* of the groove 60 to cam the locking fingers 80 radially outward. The locking teeth 84 move onto the cylindrical outer surface 52 of the inner tube 16.

The handle assembly 10 is then in the fully unlocked condition shown in FIG. 4 and can be readily adjusted to a different length and there locked.

From the above description of the invention, those skilled in the art will perceive improvements, changes and modifications in the invention. Such improvements, changes and modifications within the skill of the art are intended to be covered by the appended claims.

Having described the invention, I claim:

1. A telescoping handle assembly comprising inner and outer telescoping handle sections;

said inner handle section having an outer surface and a series of grooves extending inward from said outer surface at predetermined locations spaced along the length of said inner handle section, said grooves defining predetermined locking positions of said inner handle section relative to said outer handle section;

said outer handle section including locking teeth that are fixed axially in position along the length of said outer handle section and that are resiliently movable between a locked condition disposed in one of said grooves on said inner handle section and an unlocked condition;

said handle assembly including a locking sleeve movable in a first direction to apply radially inwardly directed force to said locking teeth to maintain said locking teeth in the locked condition and thereby to block telescopic movement of said inner handle section relative to said outer handle section;

said locking sleeve being movable in a second direction opposite said first direction to enable movement of said locking teeth out of the locking condition thereby to enable telescopic movement of said inner handle section relative to said outer handle section;

said handle assembly comprising an internal wedge surface being movable with said locking sleeve and engageable with outer wedge surfaces on said teeth to apply radially inwardly directed force to said teeth.

2. A handle assembly as set forth in claim 1 wherein said locking sleeve is manually rotatable in a first direction to a first position in which it applies inwardly directed force to said locking teeth to maintain said locking teeth in the locked condition, and is manually rotatable in a second direction opposite said first direction to a second position in which it enables movement of said locking teeth out of the locking condition.

3. A handle assembly as set forth in claim 1 wherein said locking sleeve requires at least two full turns of rotation about an axis to move between its first position and its second position.

4. A handle assembly as set forth in claim 2 wherein said locking sleeve and said teeth have respective secondary locking surfaces that abuttingly engage when said locking sleeve is in its first position and said internal wedge surface on said locking sleeve is engaged with said outer wedge surfaces on said teeth, said secondary locking surfaces remaining in abutting engagement to maintain radially inwardly directed force on said teeth during movement of said locking sleeve in said second direction from its first position to its second position.

5. A handle assembly as set forth in claim 4 wherein said secondary locking surfaces remain in abutting engagement during at least two full turns of rotation of said locking sleeve about said axis from its first position to its second position.

6. A handle assembly as set forth in claim 1 further comprising a rigid head attached to said inner tube, said head having a first surface adapted for engagement with a first mechanism of a railroad car to adjust the first mechanism by pulling on the telescoping handle assembly and thereby placing said handle assembly in tension, said head having a second surface adapted for engagement with a second mechanism of a railroad car to adjust the second mechanism by pushing on the telescoping handle assembly and thereby placing said handle assembly in compression.

7. A handle assembly as set forth in claim 1 wherein said each one of said grooves has first and second locking surfaces extending transverse to a longitudinal central axis of said handle assembly, each one of said teeth having first and second locking surfaces extending transverse to said longitudinal central axis of said handle assembly, said first locking surface on said tooth being in abutting engagement with said first locking surface of said groove and said second locking surface on said tooth being in abutting engagement with said second locking surface of said groove when said telescoping handle assembly is in any one of said predetermined locking positions.

8. A telescoping handle assembly comprising interfitting first and second telescoping handle sections;

said first handle section having an outer surface and a series of grooves extending inward from said outer surface at predetermined locations spaced along the length of said first handle section, said grooves defining predetermined locking positions of said first handle section relative to said second handle section;

said second handle section including locking teeth that are fixed axially in position along the length of said second handle section and that are movable between a locked condition disposed in one of said grooves on said first handle section and an unlocked condition;

said handle assembly comprising a locking sleeve being movable in a first direction to apply radially inwardly directed force to said locking teeth to maintain said locking teeth in the locked condition and thereby to block telescopic movement of said first handle section relative to said second handle section;

said locking sleeve being movable in a second direction opposite said first direction to enable movement of said locking teeth out of the locking condition thereby to enable telescopic movement of said first handle section relative to said second handle section;

wherein said first handle section is telescopically slidable within said second handle section and said locking sleeve is manually rotatable at least one full turn to move said locking sleeve into a position enabling telescopic movement of said first and second handle sections; and wherein said locking sleeve carries an internal wedge surface for applying radially inwardly directed force to said locking teeth when said handle assembly is in the locked condition.

9. A handle assembly as set forth in claim 8 further comprising a rigid head attached to said first handle section, said head having a first surface adapted for engagement with a first mechanism of a railroad car to adjust the first mechanism by pulling on the telescoping handle assembly and thereby placing said handle assembly in tension, said head having a second surface adapted for engagement with a second mechanism of a railroad car to adjust the second mechanism by pushing on the telescoping handle assembly and thereby placing said handle assembly in compression.

10. An handle assembly as set forth in claim 9 wherein said locking sleeve requires at least about two full turns of rotation about an axis in said second direction to enable movement of said locking teeth out of the locking condition.

11. A handle assembly as set forth in claim 10 wherein said locking sleeve and said teeth have respective secondary locking surfaces that abuttingly engage when said internal wedge surface on said locking sleeve is engaged with outer wedge surfaces on said teeth, said secondary locking surfaces remaining in abutting engagement to maintain radially inwardly directed force on said teeth during said at least about two full turns of rotation of said locking sleeve in said second direction.

* * * * *

UNITED STATES PATENT AND TRADEMARK OFFICE

CERTIFICATE OF CORRECTION

PATENT NO. : 6,182,539 B1
DATED : February 6, 2001
INVENTOR(S) : Beverly Eugene Webster It is certified that error appears in the above-identified patent and that said Letters Patent is hereby corrected as shown below:

Column 5,
Line 54, change "1" to -- 2 --.

Signed and Sealed this

Tenth Day of September, 2002

*Attest:*

*Attesting Officer*

JAMES E. ROGAN
*Director of the United States Patent and Trademark Office*